United States Patent [19]

Tosa

[11] 4,417,464

[45] Nov. 29, 1983

[54] NIB FOR FORMING TOOL FOR BOLT HEADS OR NUTS

[75] Inventor: Akio Tosa, Gifu, Japan

[73] Assignee: Mitsutoyo Kiko Co., Ltd., Kasugai, Japan

[21] Appl. No.: 320,963

[22] PCT Filed: Mar. 13, 1981

[86] PCT No.: PCT/JP81/00057

§ 371 Date: Nov. 4, 1981

§ 102(e) Date: Nov. 4, 1981

[87] PCT Pub. No.: WO81/02697

PCT Pub. Date: Oct. 1, 1981

[30] Foreign Application Priority Data

Apr. 18, 1980 [JP] Japan ..... 55-34622

[51] Int. Cl.[3] ..... B21J 13/02; B21K 1/46; B21K 1/64

[52] U.S. Cl. ..... 72/478; 10/24; 10/85

[58] Field of Search ..... 10/24, 26, 85; 72/352, 72/354, 357, 358, 467, 478, 481

[56] References Cited

U.S. PATENT DOCUMENTS 567,606 9/1896 McCool et al. ..... 72/478 X
1,971,548 8/1934 Wilcox ..... 10/85 X
1,977,163 10/1934 Wilcox ..... 10/85
2,578,229 12/1951 Clement et al. ..... 72/478 X

FOREIGN PATENT DOCUMENTS 712558 10/1931 France ..... 72/467
467546 6/1937 United Kingdom ..... 72/467
564071 7/1977 U.S.S.R. ..... 72/478

*Primary Examiner*—Ervin M. Combs
*Attorney, Agent, or Firm*—Oblon, Fisher, Spivak, McClelland & Maier

[57] ABSTRACT

The present invention relates to a nib for a forming tool of bolt head or nut, wherein a nib 7 to be used for a tool comprises a segment combination nib 2 composed of a plurality of nib segments 1, and a regular polygonal hole 6 is formed at the inside of the nib. Regular polygon is formed also at the outside of the segment combination nib 2, and a bush 3 having the same shape as the nib 2 is fitted thereto so as to reinforce the nib 7. Moreover, stress absorbing hole 9 is formed on edge portion inner circumference of the bush 3 or outer surface of the segment combination nib 2. Since the stress absorbing hole 9 serves to absorb stress concentration applied to the nib segments 1, the nib 7 is not liable to flaw in comparison to prior art and stopping of the machine for exchange of the nib 7 is scarcely needed. Accordingly a forming tool with effect of improving the productivity can be provided.

8 Claims, 9 Drawing Figures

NIB FOR FORMING TOOL FOR BOLT HEADS OR NUTS

DESCRIPTION

1. Technical Field

This invention relates to a nib for a forming tool of bolt head or nut, in which a plurality of nib segments of sintered hard alloy with sectional area of symmetric trapezoid are combined into a segment combination nib of regular polygon and a bush is fitted intimately around segments or the segment combination nib, wherein part of the bush is provided with notches thereby durability of the nib is improved.

2. Background Art

When bolt head or nut is to be machined in cold heading or trimming, trimming punch or finishing punch is used usually with a nib of sintered hard alloy fitted thereto. In this case the nib of sintered hard alloy is provided with a hole corresponding to shape of bolt head or nut to be machined.

Sintered hard alloy is superior in abrasion hardness and strength against compression but inferior in strength against tensile stress. A nib of sintered hard alloy therefore is reinforced by pushing it into a nib case called punch case or die case for force fit or shrinkage fit. Even if the nib is reinforced by the nib case, however, sintered hard alloy is fatigued by applying repeated load even below allowable value until crack or flaw occurs in edge portion of the nib.

Flawed portion of the nib is enlarged on account of stress concentration until the nib itself is broken. A flawed nib in turn flaws machined article. Therefore, a flawed nib must be exchanged at once.

However, exchange of the nib is not preferable, since the nib of above mentioned structure is expensive and stopping the machine for every nib exchange causes reduction of productivity. Advent of a nib with high durability therefore has been eagerly desired in the industry.

In order to eliminate above mentioned disadvantages, a nib is proposed where six or four pieces of nib segments, for example, are combined into a segment combination nib with a hole of regular hexagonal or square shape. A bush is fitted intimately around the segment combination nib, and in turn a nib case is fitted intimately around the bush. In such a segment combination nib, stress concentrated in edge portion of nib inner circumference is absorbed by dividing the nib into segments. Therefore, the edge portion of the nib inner circumference is not liable to crack or flaw.

Dividing the nib into segments, however, causes new defect that boundary region between segment is liable to crack. Reason of the crack generation in boundary region may be explained by various factors such as (a) stress from strain, (b) maximum stress, (c) strain energy and (d) deformation energy, but there is no established theory.

An object of the present invention is to provide a nib for a forming tool of bolt head or nut wherein crack generation in boundary region between nib segments as seen in conventional segment combination nib is prevented, thereby improving durability.

SUMMARY OF INVENTION

In a nib for a forming tool of bolt head or nut according to the present invention, a plurality of nib segments with sectional surface of symmetric trapezoid are combined into a segment combination nib with inner and outer circumference of regular polygon. A bush with inner circumference of regular polygon is fitted intimately around the segment combination nib, the regular polygon in inner circumference of the bush being similar to that in outer circumference of the segment combination nib. Moreover, a stress absorbing hole is formed on edge portion of outer circumference of the segment combination nib or inner circumference of the bush. In such constitution, boundary region between segments is not liable to crack. Accordingly a nib for a forming tool of bolt head or nut is provided with long life in comparison to conventional one.

BEST MODE FOR CARRYING OUT THE INVENTION

The present invention will now be described more in detail referring to the accompanying drawings.

Figure 1:
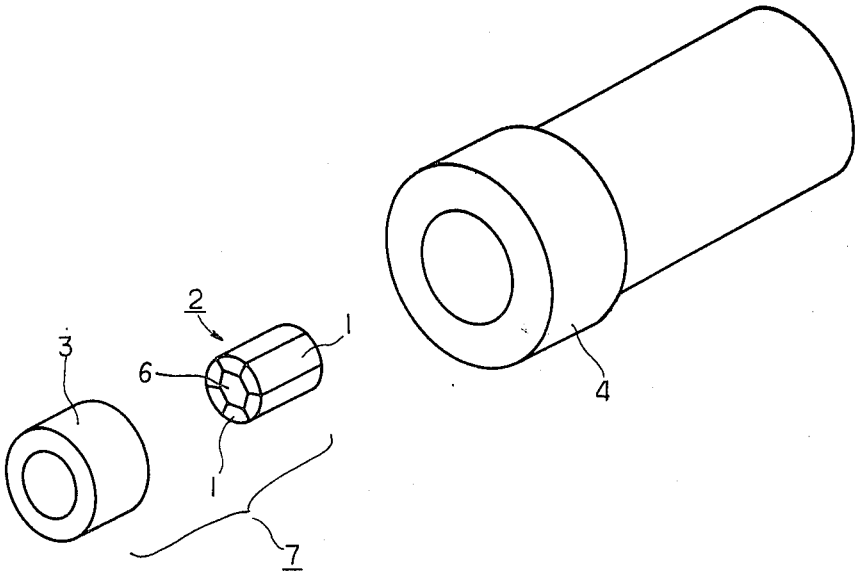
Fig. 1 PRIOR ART
FIG. 1 is an exploded perspective view of a finishing punch in schematic representation using a segment combination nib in prior art.

FIG. 1 shows an example in prior art using a segment combination nib 2. Six pieces of nib segments 1 are combined to form a hole 6 of regular hexagonal shape at the inside, a bush 3 is fitted intimately around the six nib segments 1 so as to constitute a nib 7, and in turn a nib case 4 is fitted intimately around the nib 7.

Figure 2:
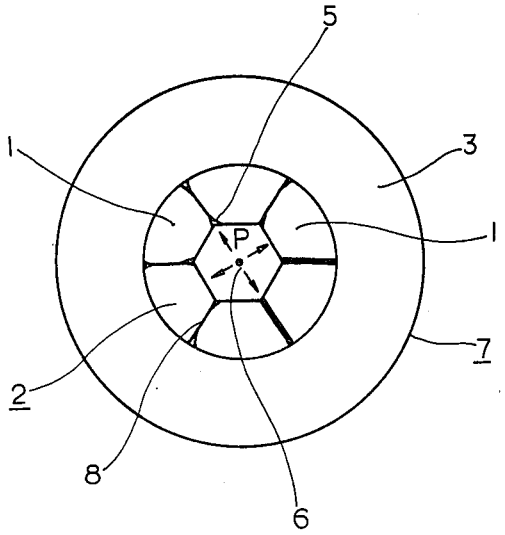
Fig. 2 PRIOR ART
FIG. 2 is a front view illustrating breaking state of nib segments in FIG. 1.

FIG. 2 is a front view of the nib 7 shown in FIG. 1, and illustrates state that crack 5 occurs in boundary region between the nib segments 1 after use.

The inventor assumed the reason for generation of the crack 5 in that pressure P applied from the center of the hexagonal hole 6 towards the bush 3 during use of the nib 7 causes stress within the nib segments 1, and that the stress is concentrated in boundary region 8 between the nib segments 1. The present invention is based on the above assumption, and embodiments of the invention are hereinafter described referring to FIGS. 3–9.

Figure 3:
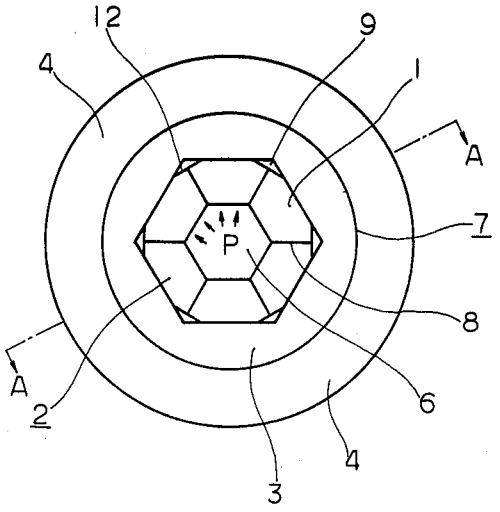
FIG. 3 is a front view of essential part of a first embodiment of the present invention.

FIG. 3 is a front view of a first embodiment of the invention.

As shown in FIG. 3, a nib 7 for a forming tool in the first embodiment comprises nib segments 1 with sectional area of symmetric trapezoid and edge portion 12 of each segment 1 at the bottom of trapezoid is notched. The nib segments 1 are combined into a segment combination nib 2 with a hexagonal hole 6 constituted at the inside. A bush 3 with hexagonal inner circumference is fitted intimately around the segment combination nib 2.

A nib case 4 is fitted intimately around the nib 7 composed of the nib segments 1 and the bush 3. The nib 7 in such constitution is provided with stress absorbing hole 9 formed by inner circumference of the bush 3 and the segment combination nib 2.

The stress absorbing hole 9 serves to relieve stress concentrated in boundary region 8 between the segments as described in the assumption.

The nib 7 in the first embodiment may be used for a finishing punch where bolt head or nut is inserted in the hexagonal hole 6 and the forming is carried out by cold heading, or for a trimming punch where bolt head or nut after coarse machining is passed through the hexagonal hole 6 and the trimming is carried out at the outside of bolt head or nut.

Figure 4:
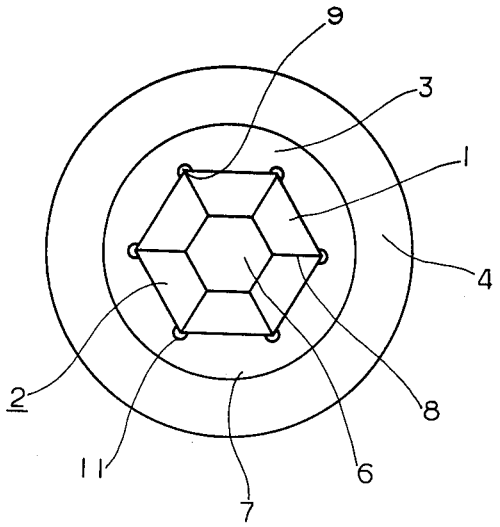
FIG. 4 is a front view of essential part of a second embodiment of the present invention.

FIG. 4 is a front view of the second embodiment, in which a notch 11 is constituted at edge portion of inner surface of a bush 3 on the contrary with the edge portion 12 of the nib segment 1 of the embodiment in FIG. 3. In the second embodiment also stress absorbing hole 9 is formed by inner circumference of the bush 3 and outer circumference of the segment combination nib 2 as in FIG. 3.

Figure 5:
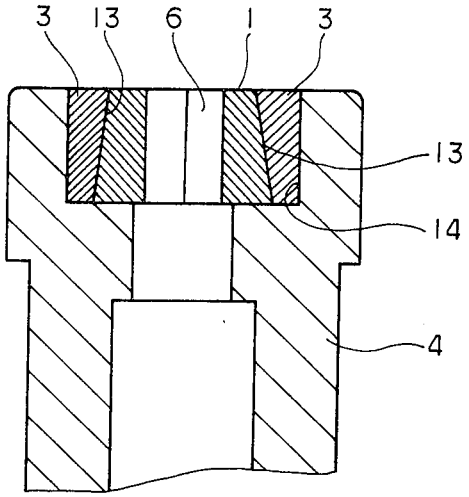
FIG. 5 is a sectional view of a finishing punch in a third embodiment of the present invention.

FIG. 5 shows a nib for a finishing punch in a third embodiment of the invention. In the third embodiment, stress absorbing hole (not shown) is formed and taper machining (13) is applied to fitting surface between nib segments 1 and a bush 3. The taper machining 13 prevents the nib segments 1 from slipping out of the bush 3 in use.

Figure 6:
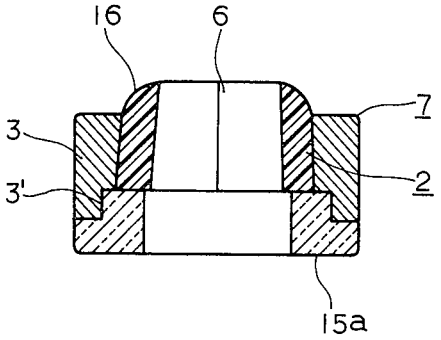
FIG. 6 is a sectional view of a trimming punch in a fourth embodiment of the present invention.

FIG. 6 is a sectional view of a fourth embodiment wherein a nib 7 is used for a trimming punch. In the fourth embodiment, a segment combination nib 2 projects beyond a bush 3, and a taper surface 16 is formed on the projecting portion. The bush 3 of the nib 7 is provided with a stepped portion 3' and a nib case 15*a* is machined corresponding to shape of the stepped portion 3' and then fitted to the stepped portion 3'.

In the fourth embodiment also, stress absorbing notch is constituted either in nib segments 1 or in the bush 3.

Figure 7:
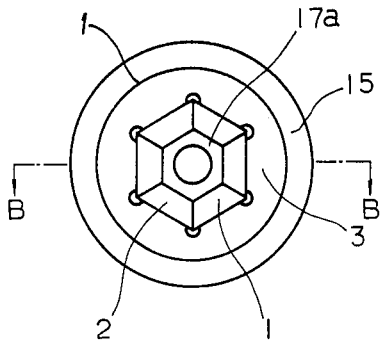
FIG. 7 is a front view of a finishing punch in a fifth embodiment of the present invention.
Figure 8:
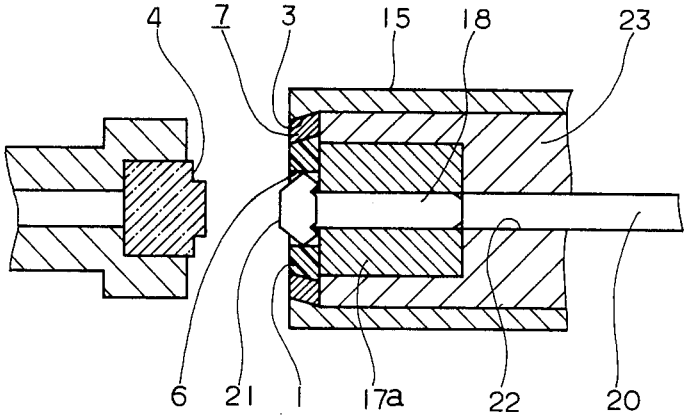
FIG. 8 is a sectional view along the line B—B in FIG. 7 illustrating use state of the finishing punch.

FIG. 7 shows a fifth embodiment of the invention wherein a nib 7 is used for a finishing punch of upset bolt. FIG. 8 illustrates use state of the embodiment in FIG. 7.

In the fifth embodiment, the nib 7 is provided at the inside in the axial direction with a support 17*a*, which is in turn provided with a circular hole 18 at the inside and inserted in a punch supporting member 23. The support 17*a* together with the nib 7 and the punch supporting member 23 is fitted to a finishing punch case 15. The punch supporting member 23 is provided with a projecting pin hole 22 adjusted to the inner diameter of the circular hole 18 of the support 17*a* so as to enable insertion of the projecting pin.

In the fifth embodiment constituted as above described, an upset bolt 21 as a whole is inserted in the finishing punch and cold heading is carried out from head of the bolt 21 using a hexagonal broach 4. After the heading is finished, the bolt 21 is taken out of the punch using the ejector pin 20.

Figure 9:
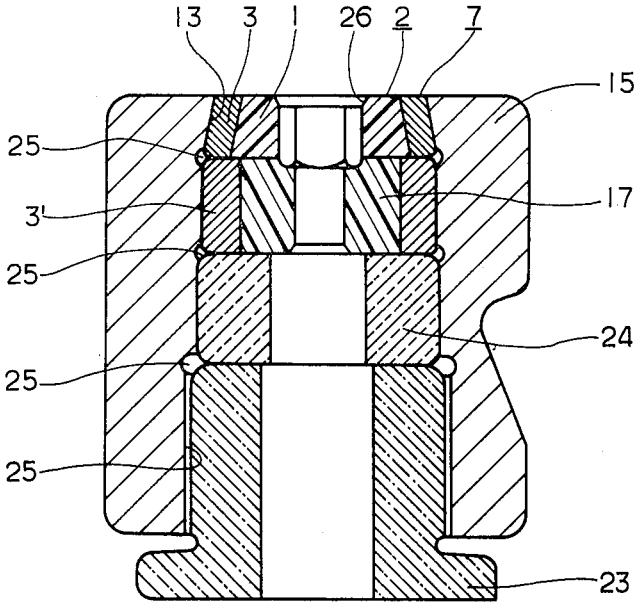
FIG. 9 is a sectional side view of a finishing punch in a sixth embodiment of the present invention.

FIG. 9 shows a sixth embodiment of the invention wherein a nib 7 is used for a finishing punch of a washer based bolt or nut. The sixth embodiment comprises a cylindrical punch supporting member 23 having a circular hole at the center, a cylindrical spacer 24 disposed on the punch supporting member 23 and having a circular hole with diameter slightly smaller than that in the member 23, an inner nib 17 disposed on the cylindrical spacer 24 having a bush 3' fitted around the nib 17, and a segment combination nib 2 having stress absorbing hole (not shown) at boundary region to a bush 3 and a hexagonal hole at the inside. The above mentioned five components are covered by a punch case 15 from the outside. Inner circular hole near the inlet of the segment combination nib 2 leads through a tapered surface to the hexagonal hole. A tapered surface 26 adjacent the inlet is adapted for washer portion of a washer based bolt or nut. A tapered surface 13 is constituted in outer circumference of the segment combination nib 2 and the bush 3 so as to prevent the nib segments 1 from slipping off. Outer circumference of the bush 3 also has a tapered surface in parallel to that in inner circumference, whereby the bush 3 is fitted to the case of the nib 7. A notch 25 is formed to part of outer boundary surface of the nib 7, the bush 3', the spacer 24 and the nib supporting member 23 and contact portion of the outer boundary surface with the punch case 15, so that air which might otherwise cause an air cushion adversely affecting the forming or liquid such as oil which might otherwise cause a hydro-cushion are permitted to escape.

As above described, a nib of the present invention comprises combination of a plurality of nib segments and a bush fitted intimately around the segments, and stress absorbing hole for the nib is formed by partly notching the nib segments or the bush. The stress absorbing hole serves to absorb internal pressure P in radial direction from the inside of polygonal hole and tensile stress (or hoop stretching stress) in peripheral direction from the outer bush applied to the nib as shown in FIG. 3 during forming of bolt head or nut. The stress absorbing hole also reduces rate of crack generation at edge portion of the nib and boundary region between nib segments.

Accordingly, although a nib in prior art as shown in FIG. 1 must be exchanged after machining of bolt head or nut at every $1\times10^4$ times in mean value, a nib of the invention as shown in FIG. 3 or FIG. 4 can be used in machining at $20\times10^4$ times in mean value.

Industrial Applicability

A nib for a forming tool of bolt head or nut according to the present invention is useful for forming tools such as a finishing punch in cold heading or a trimming punch in trimming working, and suitable for forming of bolt head or nut in regular polygon such as hexagonal or rectangular shape.

I claim:

1. A nib for a forming tool used to form bolt heads or nuts, said nib comprising:

(a) a plurality of nib segments each one of which has a surface perpendicular to the axis of the tool in the shape of a symmetric trapezoid:

(i) the shorter parallel side of which defines one edge of a central work-receiving volume the cross-sectional shape of which perpendicular to the axis of the tool is a first regular polygon, (ii) the longer parallel side of which defines one edge of the outer circumference of a segment combination nib the cross-sectional shape of which perpendicular to the axis of the tool is a second regular polygon which is similar to, concentric with, and angularly congruent to the first regular polygon, and (iii) the non-parallel sides of which are radial to the axis of the tool and (b) a bush intimately fitted around said segment combination nib, said bush having a central opening parallel to the axis of the tool the cross-sectional shape of which perpendicular to the axis of the tool is the same as said second polygon, (c) a stress-absorbing hole being defined at the intersection of each of the non-parallel sides of said nib segments with the vertices of said second polygon, said stress-absorbing holes extending axially parallel to the axis of the tool and being symmetrical with respect to the plane defined by adjacent ones of the non-parallel sides of said nib segments.

2. A nib as recited in claim 1 wherein said first and second polygons are hexagons.

3. A nib as recited in claim 1 wherein said stress-absorbing holes are formed in said nib segments, half of each of said stress-absorbing holes being formed in one of each adjacent pair of nib segments and half being formed in the other of said adjacent pair of nib segments.

4. A nib as recited in claim 3 wherein said stress-absorbing holes are formed by flat chamfers on the edges of said nib segments formed by the intersections of one of the non-parallel sides and the longer parallel side of said nib segments, said flat chamfers being perpendicular to the plane defined by adjacent ones of the non-parallel sides of said nib segments.

5. A nib as recited in claim 1 wherein said stress-absorbing holes are formed in said bush, half of each of said stress-absorbing holes being on one side of the extension of the plane defined by adjacent ones of the non-parallel sides of said nib segments and half being on the other side of the extension of said plane.

6. A nib as recited in claim 5 wherein the shape of said stress-absorbing holes perpendicular to the axis of the tool is a part circle.

7. A nib as recited in claim 1 wherein a tapered surface is formed on the fitting surface between the outer circumference of said segment combination nib and the inner circumference of said bush.

8. A nib as recited in claim 1 wherein:

(a) said segment combination nib projects beyond said bush in the outer axial direction and (b) the portion of said segment combination nib whic projects beyond said bush has a tapered outer surface.

* * * * *